US006078491A

United States Patent [19]

Kern et al.

[11] Patent Number: 6,078,491

[45] Date of Patent: Jun. 20, 2000

[54] HYBRID RELAY

[75] Inventors: Josef Kern, Berlin; Bican Samray, Schönow, both of Germany

[73] Assignee: Siemens Aktiengesellschaft, Munich, Germany

[21] Appl. No.: 09/180,423

[22] PCT Filed: Apr. 22, 1997

[86] PCT No.: PCT/DE97/00804

§ 371 Date: Nov. 9, 1998

§ 102(e) Date: Nov. 9, 1998

[87] PCT Pub. No.: WO97/42642

PCT Pub. Date: Nov. 13, 1997

[30] Foreign Application Priority Data

May 7, 1996 [DE] Germany ..... 196 18 288

[51] Int. Cl.[7] ..... H01H 47/00

[52] U.S. Cl. ..... 361/167; 361/190; 361/196; 361/3

[58] Field of Search ..... 361/2–3, 152, 361/160–161, 166–167, 189–190, 191, 196

[56] References Cited

U.S. PATENT DOCUMENTS

| | | | |
|---|---|---|---|
| 4,772,809 | 9/1988 | Koga et al. | 307/140 |
| 4,956,738 | 9/1990 | Defosse et al. | 361/8 |
| 5,283,706 | 2/1994 | Lillemo et al. | 361/3 |

*Primary Examiner*—Michael J. Sherry
*Attorney, Agent, or Firm*—Hill & Simpson

[57] ABSTRACT

A hybrid relay with an electromagnetic relay system having at least one coil one core yoke unit, at least one armature which switches contacts and one power semiconductor whose switching path, in combination with the contacts switches the load circuit of the relay wherein the contacts are switched on no-load by offsetting the control of the power semiconductor in time resulting in good heat dissipation and a compact design with few individual parts.

25 Claims, 10 Drawing Sheets

HYBRID RELAY

BACKGROUND OF THE INVENTION

1. Field of the Invention

The present invention relates to a hybrid relay having an electromagnetic relay system which includes at least one coil, a core yoke unit which passes through the coil, at least one armature, at least one contact pair which is switched by the armature, and a power semiconductor whose switching path, together with the at least one contact pair, switches the load circuit of the relay and whose switching time can be controlled to be offset in time with respect to that of the electromagnetic relay system wherein the contact pair is in each case switched on no-load.

2. Description of the Prior Art

When relay contacts are switched on load, they are severely stressed, primarily by the switching arc that occurs, and the large amount of heat produced can lead to welding of the contacts, or at least to undesirable material migration, to erosion and thus to a reduction in life. In order to avoid these effects, so-called hybrid relays are used which, in the manner stated initially, use an electronic switch in addition to the mechanical relay contacts. This electronic switch is operated offset in time and thus absorbs the load peaks during switching on and off; the relay contacts are in this case switched "dry" and, in consequence, can achieve a long life at low cost. Such hybrid circuits have been disclosed, for example, in DE 37 01 838 A1 or U.S. Pat. No. 4,772,809. Depending on the circumstances, relay contacts are connected either in parallel or in series with the power semiconductor in these circuits. In the former case, the power semiconductor is first switched on and then the relay contact is closed so that, in continuous operation, the load flows via the relay contact while the semiconductor need then carry only a relatively small proportion of the current or can be switched off entirely. The sequence during switching off is the reverse of this. In the second case, that is to say in the case of the series circuit, the relay contact is first closed and then the power semiconductor is switched on or, during switching off, the power semiconductor is switched off before the contacts are opened, with no current flowing through them. In this second case, the load current also flows continuously via the power semiconductor so that it also has to cope with a considerable heat loss. This series circuit is significant, for example, if two circuits have to be closed or opened precisely at the same time on a double relay or a polarity reversal relay.

In the case of conventional hybrid relays and hybrid circuits, conventionally designed electromagnet systems and standard semiconductors are connected using a conventional circuit technique. As a rule, this means that the two systems are arranged on a common printed circuit board, with a corresponding space requirement. In this case, the heat losses from the semiconductor also have to be dissipated in a conventional manner via heat sinks.

An object of the present invention, therefore, is to provide a hybrid relay of the type mentioned initially which has a compact design and which also allows good and simple heat dissipation for the power semiconductor while using as few individual parts as possible.

SUMMARY OF THE INVENTION

According to the present invention, this object is achieved in the case of a hybrid relay of the type mentioned initially in that the power semiconductor is in thermal contact with the core yoke unit of the electromagnetic relay system.

Various techniques have admittedly already been proposed for accommodating a semiconductor, or a semiconductor circuit, in the housing of an electromagnetic relay (EP 0484 587 B1). Moreover, until now, this has always been done independently of the magnet system and without any circuitry link to the contacts. In contrast, in the relay according to the present invention, the power semiconductor is mounted directly on the core yoke of the electromagnetic relay which, owing to its relatively large cross section, quickly dissipates the heat produced in the transistor; partially via its own large surface area and partially via the core winding. In this case, the magnetic circuit of the relay also carries out the function of a component mounting, at least for the power semiconductor. Alternatively, in a further embodiment, it can also be fitted with application-specific integrated circuit modules. This reduces the physical size and the volume of the hybrid relay, and semiconductors can be used without their own casing since they can be protected in the relay housing against environmental influences.

In one particularly preferred embodiment, the relay is designed as a polarity reversal relay in which the core yoke is formed in an E-shape by an essentially flat plate and two center webs, as cores, are fitted with a coil between two side limbs and one center limb.

Further, two armatures each bridge one of the side limbs and the center limb to form air gaps wherein the power semiconductor being arranged on the center limb. Since, in the case of the hybrid relay, the contacts are switched on no-load and thus are not subjected to any erosion, there is also no need to take into account any overtravel in the design. The magnetic circuit parts can therefore at the same time carry the contact current. That is to say, for example, the pole surfaces can be designed as contact surfaces. This results in a particularly simple design with few individual parts. Owing to the lack of any overtravel, the armature travel thus corresponds to the contact travel and, owing to these smaller operating air gaps in the magnet system, it is either possible to produce greater contact forces with smaller contact resistances in the load area with the same winding, or possible that a higher impedance winding can be used to produce the same contact forces as in conventional systems but with correspondingly less heating of the coil.

Additional features and advantages of the present invention are described in, and will be apparent from, the Detailed Description of the Preferred Embodiments and the Drawings.

DETAILED DESCRIPTION OF THE PREFERRED EMBODIMENTS

Figure 1:
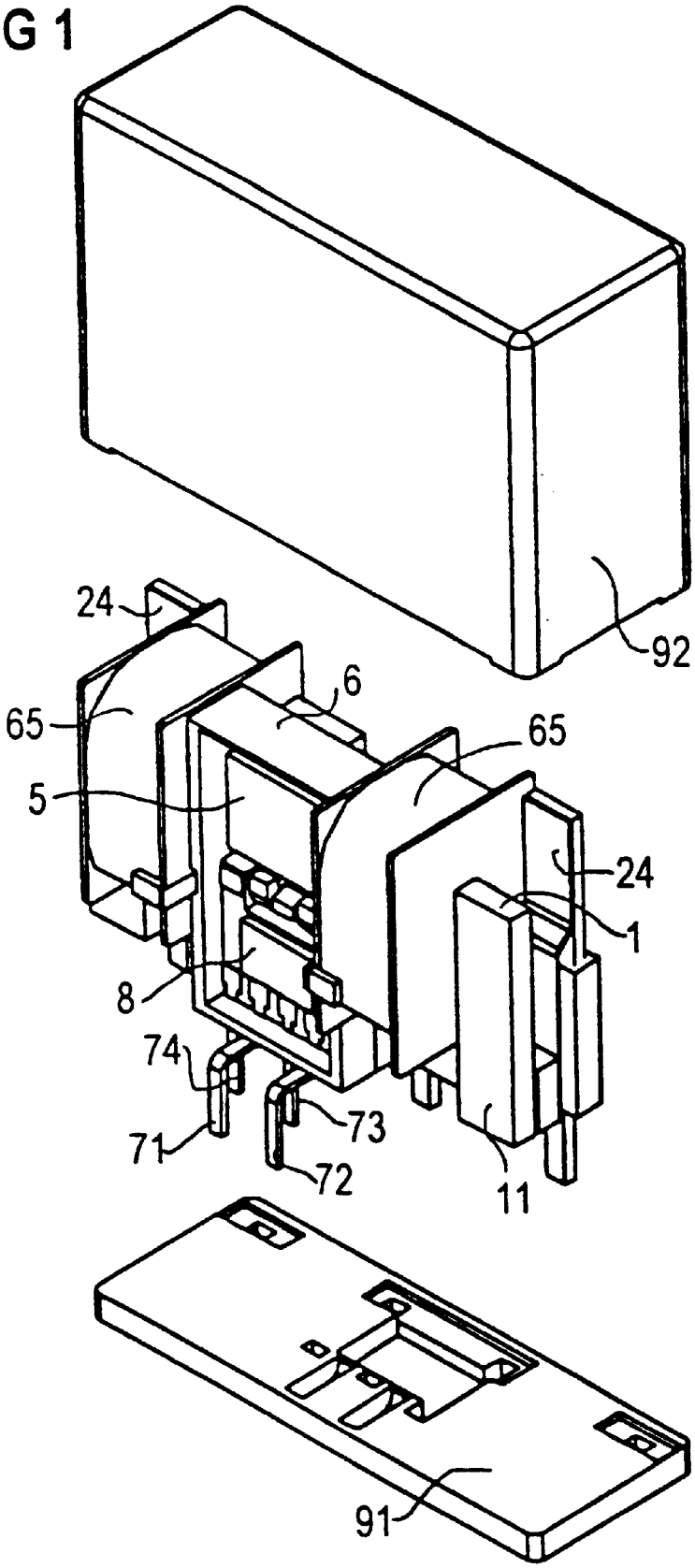
FIG. 1 shows a perspective view of a polarity reversal relay designed according to the present invention and having an open housing.
Figure 2:
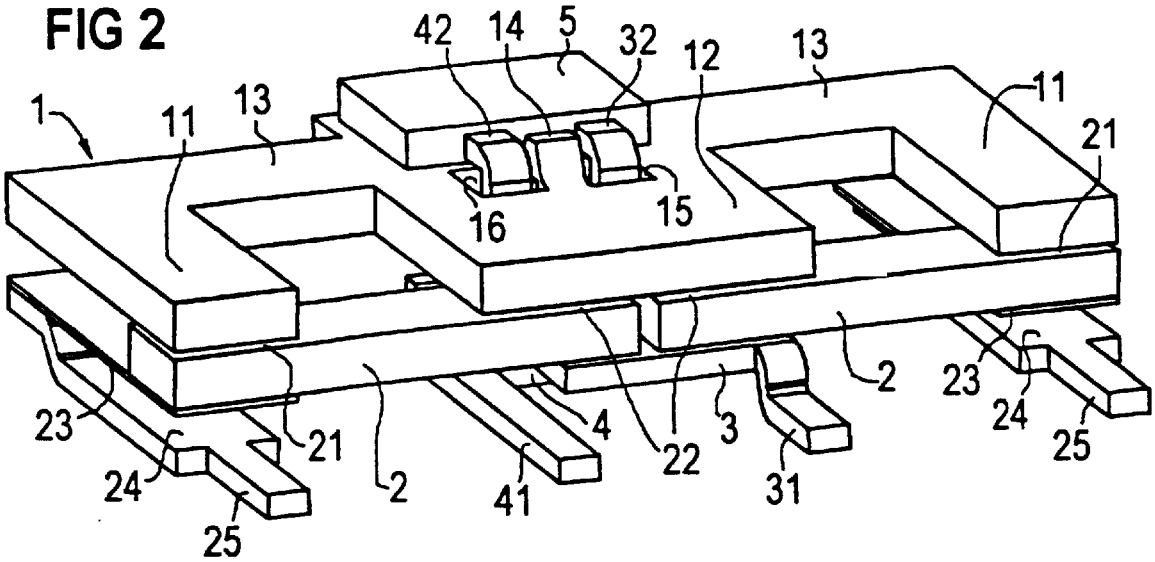
FIG. 2 shows the magnetic circuit and load circuit of the relay from FIG. 1 with the power semiconductor fitted but without coils and insulation.
Figure 3:
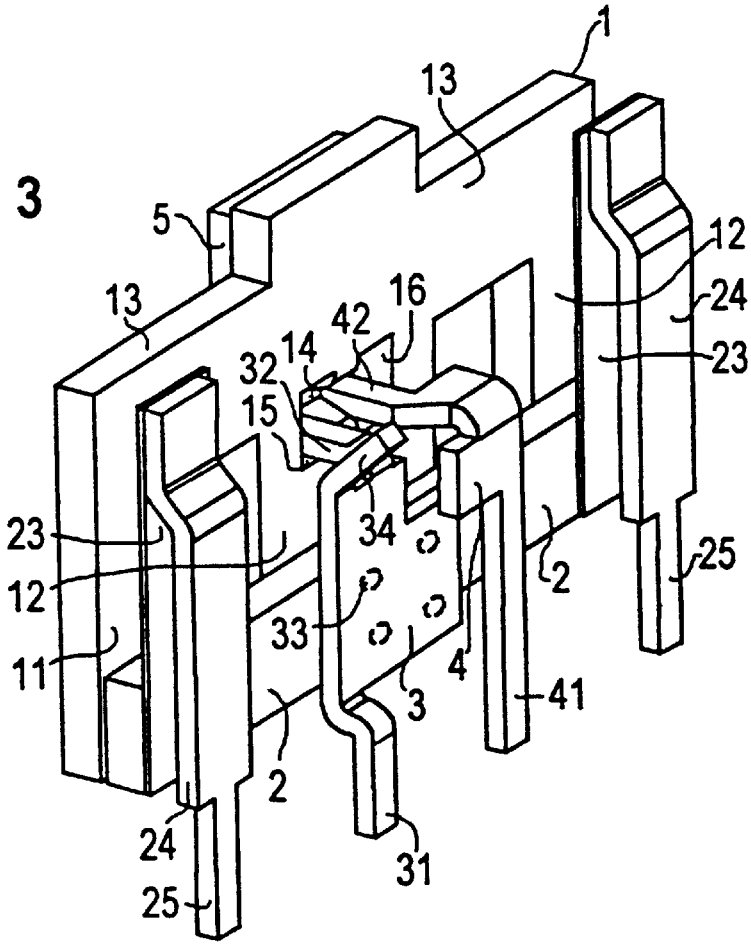
FIG. 3 shows the magnetic circuit and contact circuit from FIG. 2, in a rear view.
Figure 4:
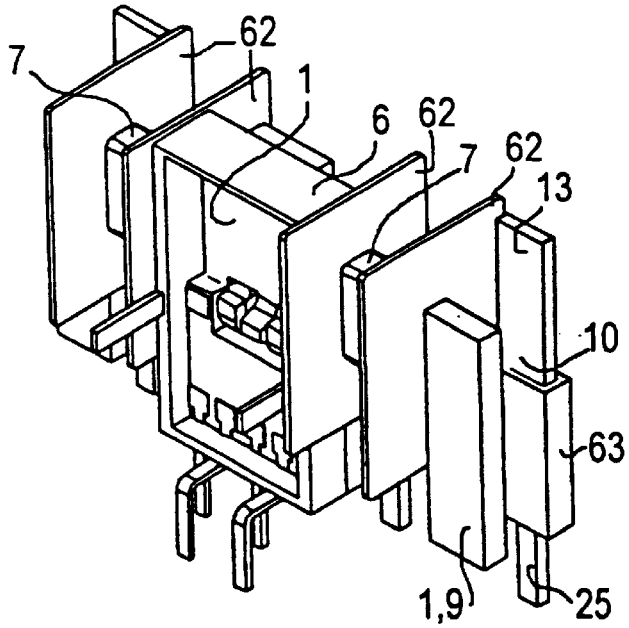
FIG. 4 shows the magnetic circuit and load circuit of the relay from FIG. 1 with an integral plastic extrusion coating which forms a coil former and fixes all the connections.
Figure 5:
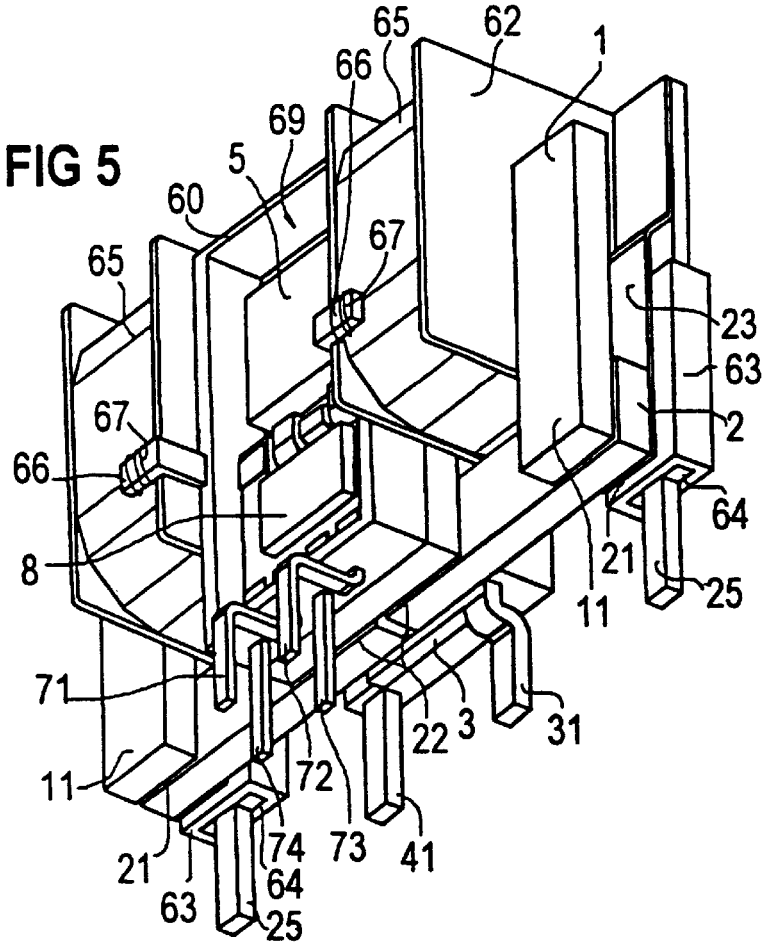
FIG. 5 shows the relay design from FIG. 4 with additionally fitted windings, in another perspective view.
Figure 6:
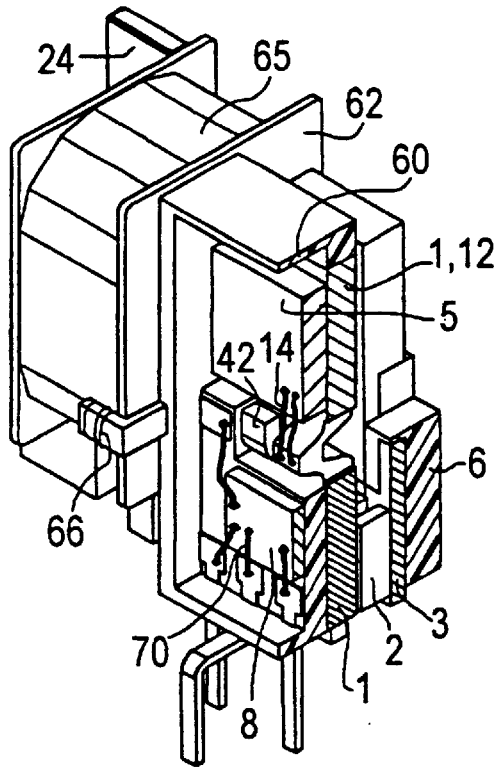
FIG. 6 shows the relay design from FIG. 5 in a perspective view, sectioned centrally.
Figure 7:
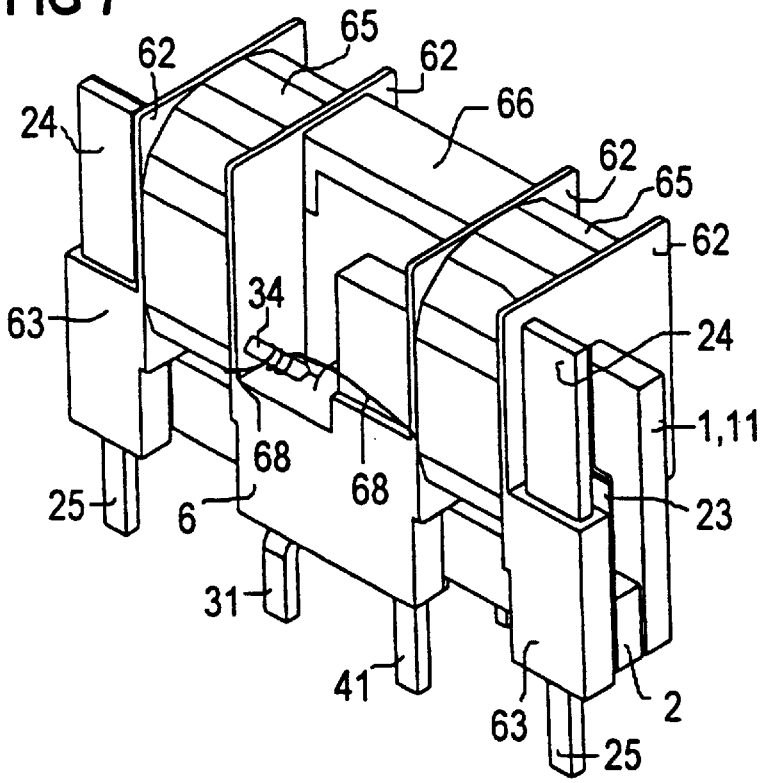
FIG. 7 shows the relay design from FIG. 5, viewed from the rear.

The relay which is illustrated in FIGS. 1 to 7 has as the mounting a magnetic circuit (FIG. 2) with a flat E-shaped core yoke 1 which has two side limbs 11 and one center limb 12, which are integrally connected via two core webs 13. Each of the core webs 13 is fitted with a winding 65.

Two flat armatures 2 are aligned with one another and are symmetrically parallel to the core yoke 1. They each bridge one free end of a side limb 11 as well as a part of the center limb 12, forming operating air gaps 21 and 22. Each of the armatures 2 is mounted via an armature resetting spring 23 on a mounting plate 24 which forms a connecting pin 25. At rest, owing to the resetting effect of the resetting springs 23, the two armatures 2 both rest on a break contact plate 3 which is arranged parallel and opposite to the center limb 12 of the core yoke 1. Wherein it forms a connecting pin 31. In addition, a ground connecting plate 4 with a connecting pin 41 is provided in the area alongside the break contact plate 3.

The center limb 12 of the core yoke 1 is designed to be sufficiently broad that, on the one hand, it forms the pole surfaces for the two operating air gaps 22 with the armatures 2 and, on the other hand, offers a large-area mounting surface for a power transistor 5 with good heat transfer. The three connections of this power transistor 5 are connected to a connecting tab 14 (which is stamped out of the core yoke 1), to a connecting lug 32 on the break contact plate 3, and to a connecting lug 42 on the ground connecting plate 4. The two connecting lugs 32 and 42 are passed through apertures 15 and 16 in the core yoke 1 to the side of the power transistor 5. The core yoke 1 is extrusion coated with thermoplastic in order to form a coil former 6 which, on each of the two sides of the center limb 12, forms a coil tube 61 for accommodating, in each case, one winding 7. The windings are bounded by flanges 62 on both sides. In the area of the side limbs 11 of the core yoke 1, a projection 63 is integrally formed on the coil former 6 with a plug-in shaft 64 for accommodating the mounting plates 24 for the armature resetting springs 23. These mounting plates alternatively could be extrusion coated with the material of the coil former 6, that is to say, embedded in the coil former 6. The armature resetting springs 23 are mounted on the mounting plates 24 by means of a welded or riveted joint.

The surfaces of the magnetic circuit parts, or of the core yoke 1 and of the two armatures 2, are in each case coated with a noble metal coating at least in the area of the air gaps 21 and 22 between the armatures 2 and the yoke limbs 11, 12, and are at the same time used to carry the current of the load circuit in the make function of the relay. The break function of the two electromagnetic changeover relay systems is carried out by the already mentioned break contact plate 3, which is coated with noble metal at least in the area where it touches the two armatures 2. The necessary contact force is, in each case, applied by the armature resetting spring 23. In order to achieve low-impedance contact and to carry current with low impedance, the two moving armatures 2 are preferably coated over their entire surface with an electrochemical; for example, silver coating. This coating can be applied economically in a very thin manner since the electromagnetic relay system had to carry only the load current. The two air gaps 21 and 22 between each armature 2 and the core yoke 1 mean that a double contact is made when the magnetic circuit closes when the load circuit switches on no-load. This considerably enhances the contact reliability. Furthermore, in the illustrated example, two embossed studs 33 on the break contact plate 3 (see FIG. 3) result in contact being made with the armature at two points, owing to the torsion of the armature spring 23. The coincidence of the magnetic circuit and the electrical load circuit means that only a small number of simple, and therefore cost-effective, parts are required for this polarity reversal relay.

Since the two armatures 2 switch over on no-load, this avoids the otherwise normal erosion of the contacts, which must be protected against as an overtravel or in the form of erosion safety for the armature travel of a relay. In the case of the relay design according to the present invention, however, the armature travel in the air gaps 21 and 22 at the same time corresponds to the distance between the contact-making surfaces (contact separation). Since there is no need to make allowance for material migration owing to arcs, there is no need for any spare distance which would otherwise have to be provided between the contacts in addition to the distance for the required withstand voltage. The magnet system thus has smaller operating air gaps than would otherwise be necessary. This allows greater contact forces and thus smaller contact resistances in the load area to be achieved for the same magnet system design. On the other hand, if the contact forces are kept the same, then a higher impedance winding than in the case of conventional magnet systems can be provided, resulting in less heating of the coil.

In the present exemplary embodiment of the relay, the power transistor 5 has no casing and is mounted directly on the center part or the center limb 12 of the core yoke 1 by means of a solder joint. It is, thus, directly connected to the opposing make contacts of the polarity reversal relay, since the drain connection of the MOSFET power transistor with the metallic solder surface, and the opposing make contacts which are formed by the core yoke one have the same polarity in the polarity-reversal circuit in the case of the circuit arrangement provided according to FIG. 8.

If, as is preferably assumed here, the control electronics are likewise arranged in the relay, this connection requires no external connection but only a connecting line for the control electronics. Such line can be provided, for example, via bonding wires 70 from the already mentioned connecting tab 14. In the present example, the control electronics are in the form of a control IC (for example an ASIC), without any casing, underneath the power transistor 5 and at about the level of the contact plane of the armature on the center limb 12. The core unit 1 is thus the mounting for the power transistor 5 and the control electronics in the IC 8, which means that there is no need for any additional component mounting, such as a printed circuit board or a ceramic mounting.

The internal connections in the relay between the power transistor 5, the control IC 8 and the outward-going control connections 71 to 74 are provided, for example, via bonding wires 70. The control connections 71 to 74 are also injection molded in the thermoplastic material of the coil former 6, in the form of a stamped grid. In addition, two coil connections 66 for the two windings 65 are embedded in the inner coil flanges 62. These coil connections 66 are bent around in the winding area once the windings 65 have been fitted and once the winding ends 67 have been soldered. The two coil connections 66 each accommodate one winding end of each coil 65 (FIG. 5), and the two other winding ends 68 (FIG. 7) are wound onto a common winding point 34, which is stamped from the plate of the common break contact plate 3, and are joined, for example by soldering.

Furthermore, a collar 60 is integrally formed in the area of the center limb 12 of the thermoplastic injection-molded part that forms the coil former 6. This collar 60 forms a cavity 69 in the form of a trough around the power transistor 5 as well as the control IC 8. After the bonding of the connecting wires between the transistor 5, the control IC 8 and the control connections 71 to 73, this cavity 69 in the form of a trough is potted with a permanently elastic potting compound (not illustrated) in order to protect the bonding wires and the semiconductors.

A thermoplastic base plate 91 and a cap 92, which is coated, for example, with thermoplastic, are used to stabilize the relay connections 25, 31, 41 as well as 71 to 74. After assembly, these two parts are sealed by a potting compound. In order to increase the surface area and thus to improve the heat dissipation, this cap 92 also can be provided with cooling ribs and/or be injection-molded from a metal-filled plastic (for example $Al_2O_3$) for greater thermal conductivity. The coil former could also be made from this $Al_2O_3$. Another option is for the cap 92 to be manufactured from a metallic, non-magnetic material, for example by deep-drawing.

Figure 8:
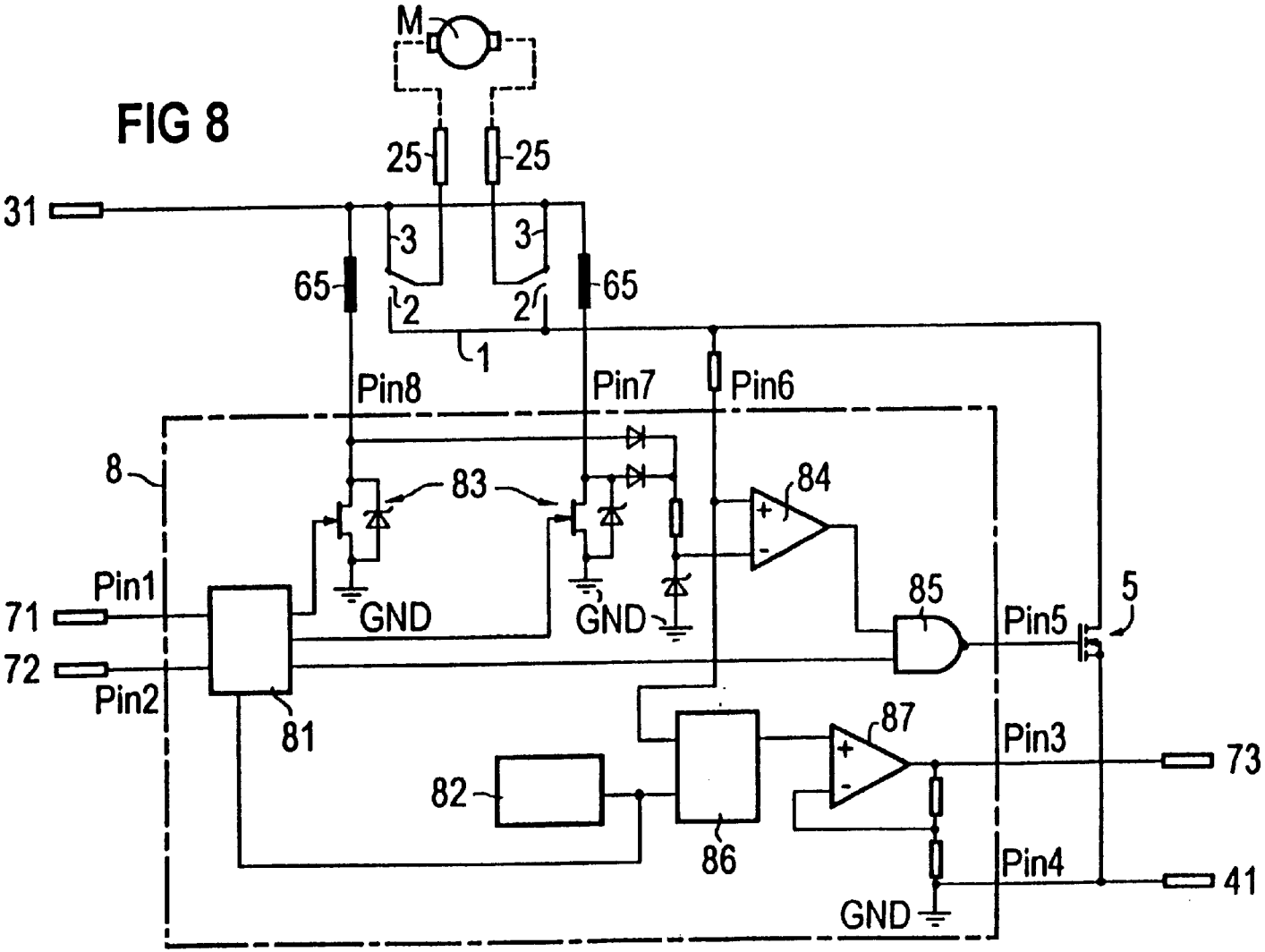
FIG. 8 shows a block diagram of a hybrid relay according to FIG. 1.

FIG. 8 shows one possible control circuit for the relay according to FIGS. 1 to 7. In this case, the same reference symbols as in the design illustration are used for those relay parts which correspond. A simplified block diagram is used for the control IC 8 as an ASIC, showing the essential functions for the timing circuit between the power semiconductor 5 and the relay system with the coils 65 and the armature contacts 2. The control IC 8 thus contains a logic circuit 81, whose clock is provided by an oscillator 82 and which optionally applies voltage to one of the coils 65 via a driver circuit 83. The power semiconductor 5 is driven via a comparator 84 and a NOR gate 85. By appropriate energization of one coil 65 or the other, a motor M is thus optionally connected to different polarities between a voltage which is connected to the connection 31 and ground, which is connected to the connection 41. The logic circuit 81 thus ensures that the relevant armature 2 is in each case switched over before the circuit is closed via the power transistor 5. The contacts are thus switched dry, that is to say on no-load, so that no arc is formed. The power supply for the ASIC is provided via the connections of the coils 65.

To the person skilled in the art, it is clear that the control circuit can also be constructed in a different manner from that illustrated in FIG. 8. In this context, it should be mentioned that the number of connections may also differ, depending on the circuit. For example, in the case of the control IC 8 illustrated in FIG. 8, there are only three control connections from the ASIC pins 1, 2 and 3 via the control connections 71, 72 and 73 together to the pin 4 via the ground connection 41 to the exterior, while in the design illustration according to FIGS. 1 to 7, four control connections 71 to 74 are shown. The connection 74 would thus remain unconnected in this case. Four or even more control connections may be routed to the outside in the case of a different control circuit configuration. Alternatively, in the same manner, it is possible to move some of the control functions or the entire drive circuit from the relay to the outside into a base or into a separate printed circuit board. However, the advantage according to the present invention would still be retained in this case for the arrangement of the power semiconductor on the core yoke, namely simple and effective cooling of the power semiconductor, and the compact design of the hybrid load circuit.

Figure 9:
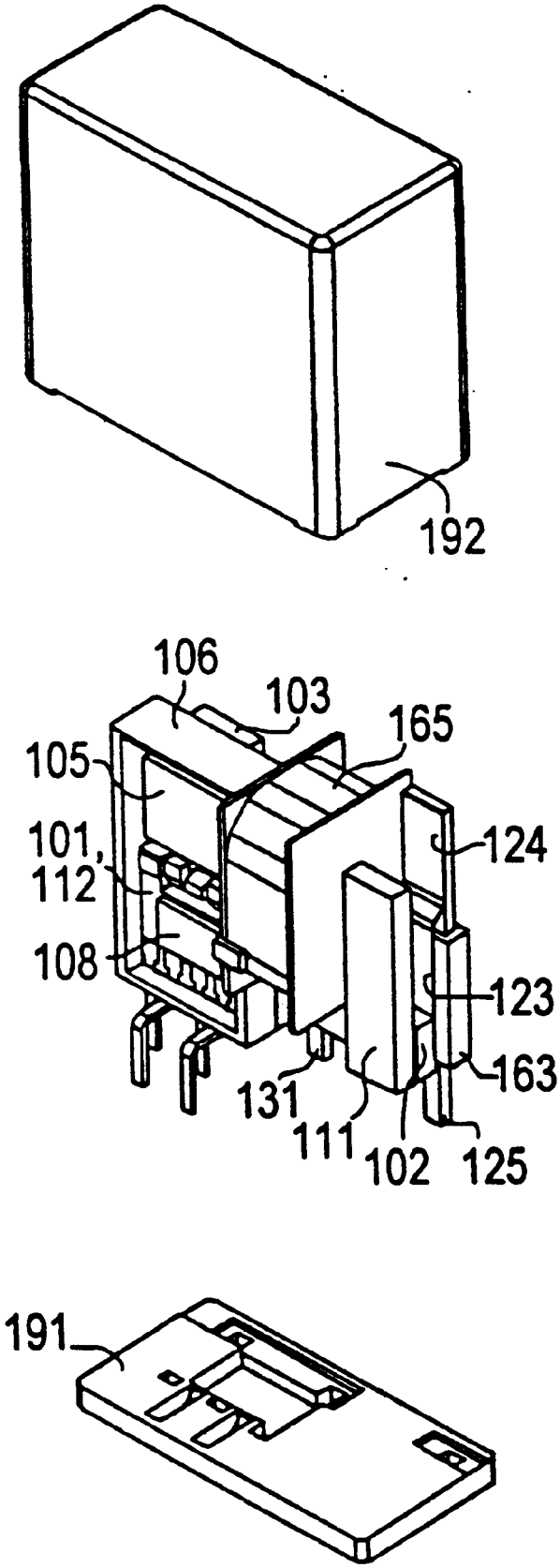
FIG. 9 shows a hybrid relay having a single electromagnet system, in a view corresponding to FIG. 1.

FIG. 9 shows a hybrid relay in an illustration comparable to FIG. 1, which differs in that only one electromagnet system is provided, having a changeover contact. Accordingly, a core yoke 101 is provided as a planar U-shaped part having two side limbs 111 and 112, on whose center web (which cannot be seen) a winding 165 is seated. A single armature 102 is mounted via an armature resetting spring 123 on a mounting plate 124 which is anchored in a projection 163 in a coil former 106 and forms a connecting pin 125. A break contact plate 103 is provided with a connection pin 131. In addition, a power transistor 105 is arranged together with a control IC 108 on the broad side limb 112 of the core yoke 101. The power transistor 105 can in this case, for example, be connected in parallel with the load circuit of the relay; the transistor 105 switching the current shortly before the armature 102 switches over and the low-impedance load circuit of the relay contacts carrying the current only after the transistor 105 has switched off. Thus, in this case, the magnetic circuit can also at the same time be used as a contact circuit having an appropriate contact coating on the pole surfaces. In the case of such a parallel circuit, the heating of the component is considerably less than in the case of a power transistor, which would have to carry the continuous current on its own. Analogously to FIG. 1, the relay according to FIG. 9 also has a housing, including a base plate 191 and a cap 192.

Figure 10:
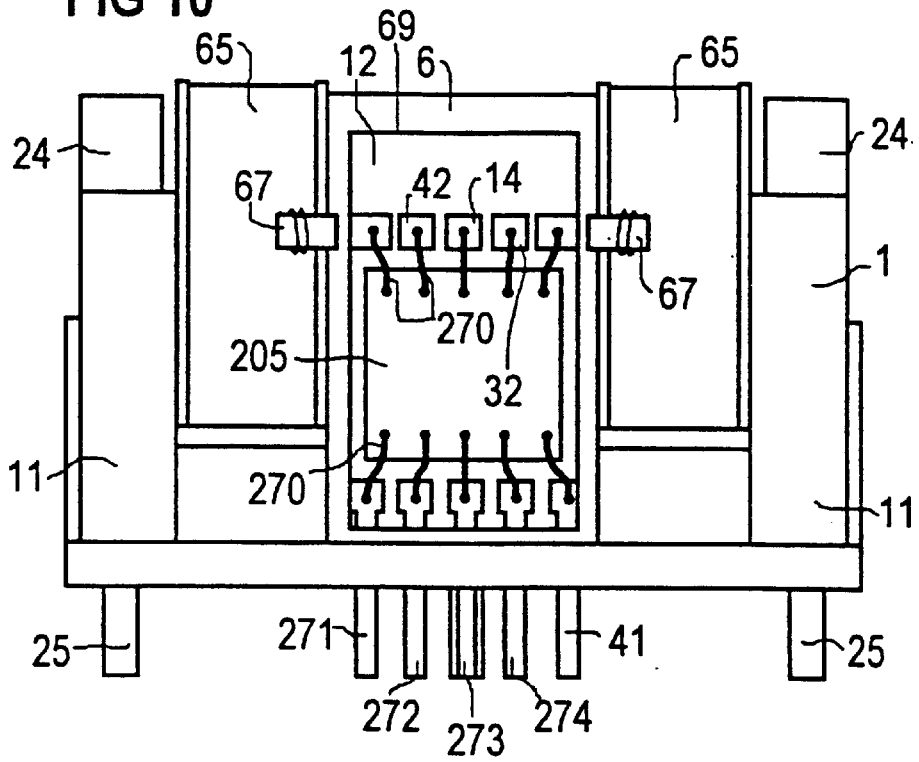
FIG. 10 shows a version of a hybrid relay similar to FIG. 1, but with an integrated circuit containing the power semiconductor and a control circuit.
Figure 11:
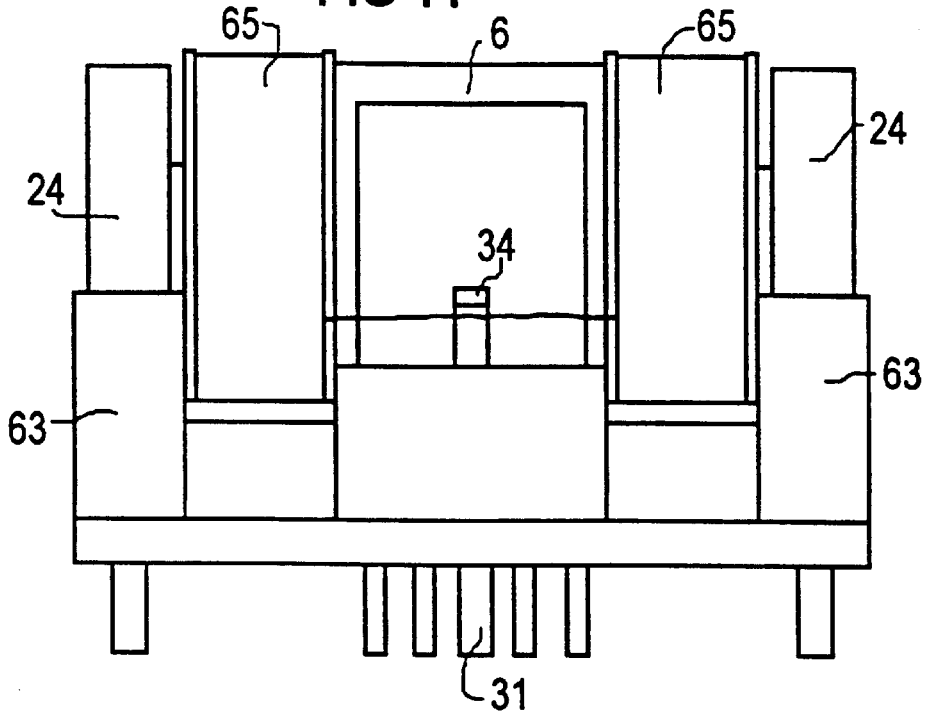
FIG. 11 shows a rear view of the relay from FIG. 10.

FIGS. 10 and 11 once again show a front view and rear view of a polarity reversal relay in which the mechanical relay system is designed in the same way as in FIGS. 1 to 7. It is therefore not intended to describe it in any more detail. In contrast to the previous example, an integrated circuit 205 is, in this case, arranged on the center limb 12 of the core yoke 1, covering both the function of the power transistor and the control circuit. This integrated circuit 205 is connected via bonding wires 270 to connecting tabs 271 to 274 which are embedded in the coil former 6. Further bonding wires form connections for the coil connecting pins 67, for the connecting lugs 32 and 42, and for the connecting tab 14. This integrated control circuit 205 is potted in the cavity 69, which is in the form of a trough, in the same way as in the previous exemplary embodiment. In this case as well, it would be possible to produce a relay with a single magnet system, analogous to FIG. 9.

Figure 12:
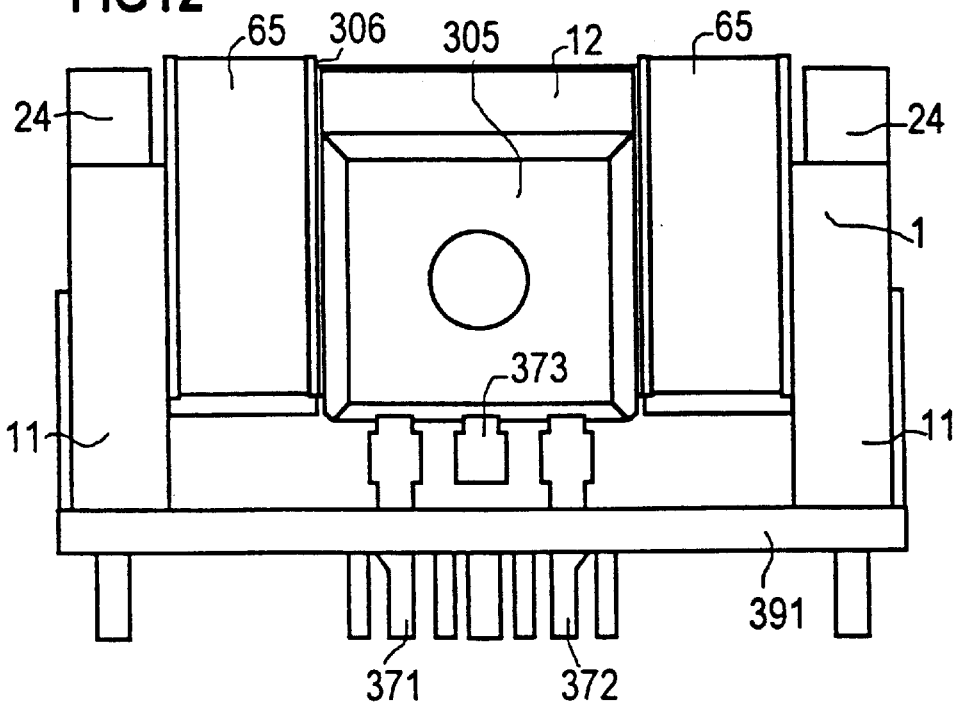
FIG. 12 shows a polarity reversal relay similar to FIG. 10, but with encased standard modules for the power semiconductor and the control circuit.
Figure 13:
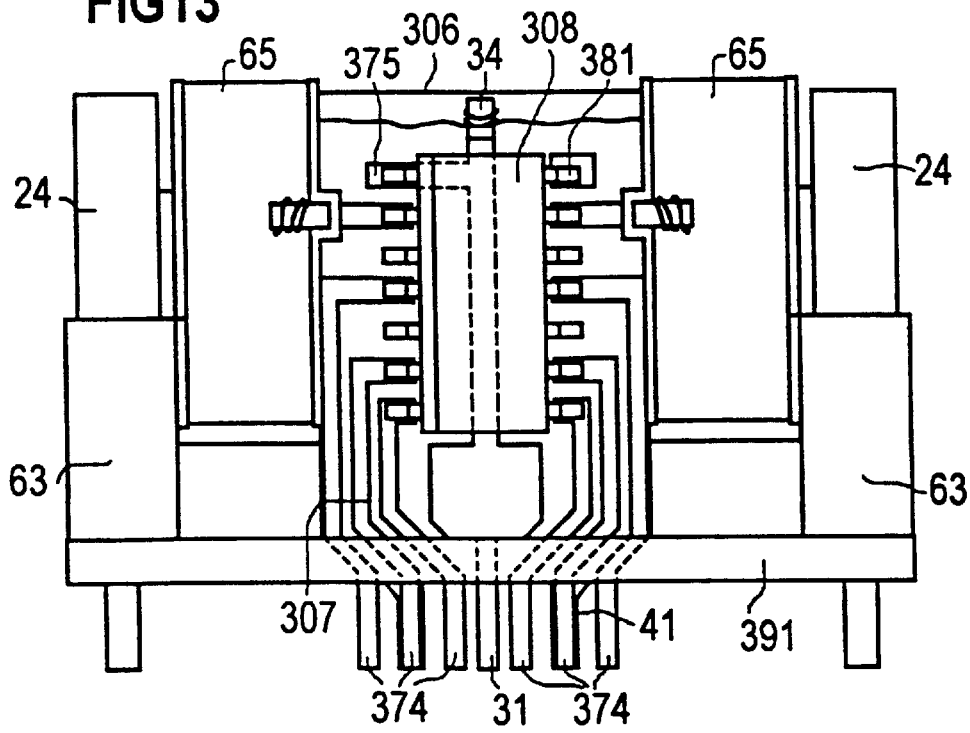
FIG. 13 shows a rear view of the relay from FIG. 12.

FIGS. 12 and 13 show a front and rear view of a relay in which the basic mechanical design is once again essentially the same as in the case of the first exemplary embodiment according to FIGS. 1 to 7. Encased standard modules are used in this case in contrast to the previous exemplary embodiment. A power transistor 305 is arranged on the front side and is mounted on the center limb 12 of the core yoke 1 over a large area by soldering or welding. The connections 371 and 372 of this standard transistor are passed directly out of the relay through the base plate 391, while the gate connection 373 is connected, inside the relay, to a control circuit.

On the side opposite the power transistor 305, a stamped grid 307 is embedded in a coil former 306, into which the core yoke 1 is injected, and those ends of this stamped grid 307 which project downward out of the injection-molded part form control connections 374 for the relay. Each conductor track of the stamped grid forms, at the opposite end, an exposed contact surface 375 which is not extrusion coated; a control IC (ASIC) 308 having SMT connecting tabs 381 is soldered to these contact surfaces 375, which lie in a plane.

This embodiment, which is particularly cost-effective for relatively small to medium-size quantities, dispenses (owing to the use of standard components) with a number of relay-internal circuit connections which were provided in the case of the first exemplary embodiment, but these circuit connections can easily be bridged externally on a printed circuit board. A single relay, that is to say a relay having only one magnet system and one changeover contact, also can be constructed analogously to FIG. 9 for this embodiment, with encased standard components. The accommodation according to the present invention of a power transistor on the highly thermally conductive core yoke of the magnetic circuit can also be accomplished with other relay designs.

Figure 14:
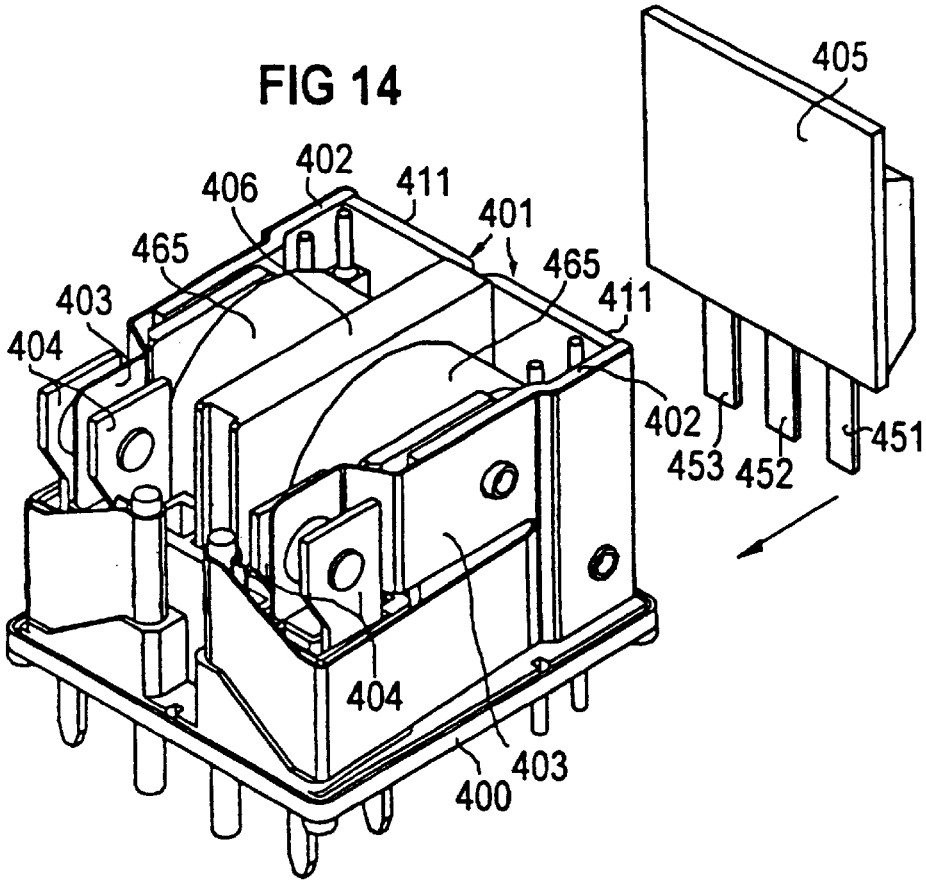
FIG. 14 shows a hybrid polarity reversal relay with a different type of design and with a power semiconductor fitted at the side.

FIG. 14 shows a double relay, in which two electromagnet systems, each having an angled yoke 401, are arranged on a flat base 400. Of the two yokes, only the outer limbs 411 which are aligned with one another can be seen. The second yoke limbs, which are arranged in a coil former center flange 406, are parallel to one another and are respectively coupled to a core (which can likewise not be seen) over which, in each case, one coil 465 is seated. An armature 402 is mounted on the free ends of each yoke limb 411 and operates a contact spring 403 that is mounted on it. The free ends of the contact springs 403 can be switched over between two opposing contact elements 404. The function of this relay design, which has already been reported previously, is self-evident to the person skilled in the art so there is no need for any further description relating to it. The two contact systems can be used separately from one another as individual systems or as changeover relays with externally connected contact connections.

Figure 15:
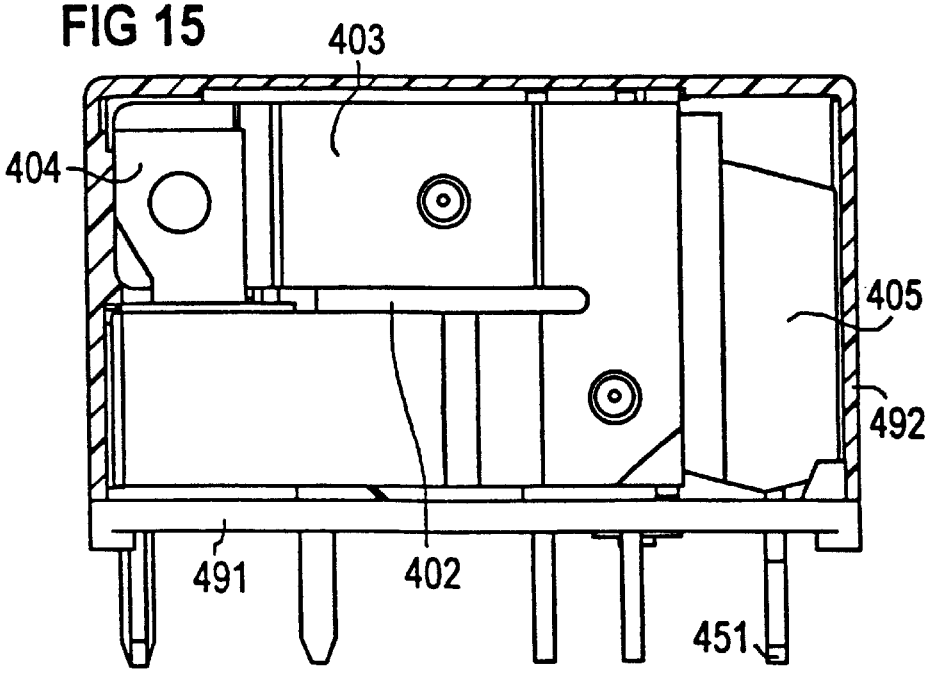
FIG. 15 shows a side view of the relay from FIG. 14.

This double relay can be expanded in a manner according to the present invention to form a hybrid relay, wherein an encased power transistor 405 is fitted in an electrically insulating but highly thermally conductive manner, for example by bonding, onto the mutually aligned outer sides of the two yoke limbs 411. To this end, the housing is just lengthened on one side; the existing double relay system is thus placed on a lengthened base plate 491 and is surrounded by a likewise enlarged cap 492 (FIG. 15). A side view of this arrangement is shown in FIG. 15 with a cutaway cap. The three connecting tabs 451, 452 and 453 of the transistor 405 are passed out directly through the base plate 491. The connections between the relay contacts and the switching path of the power transistor 405 are thus made, in the same way as the drive for the relay coils and the transistor, externally on a printed circuit board. The advantage of cooling the power transistor 405 via the magnetic circuit of the relay is, however, also used in this case.

FIG. 16 once again shows a design as in FIGS. 14 and 15 in which, in addition, the design includes a control circuit in the form of an ASIC 408. In this case, the double relay provided with the power transistor 405 is soldered onto a small printed circuit board 410, which is fitted with a control circuit 408 (indicated only as a block). The small printed circuit board 410 is also fitted with those connecting pins 409 of the entire hybrid relay which are passed out downward. In order to stabilize the position of the connecting pins and to protect the components of the ASIC controller, a thermoplastically molded plastic cap 493, in the form of a trough, is latched onto the base plate 491 from underneath.

Figure 16:
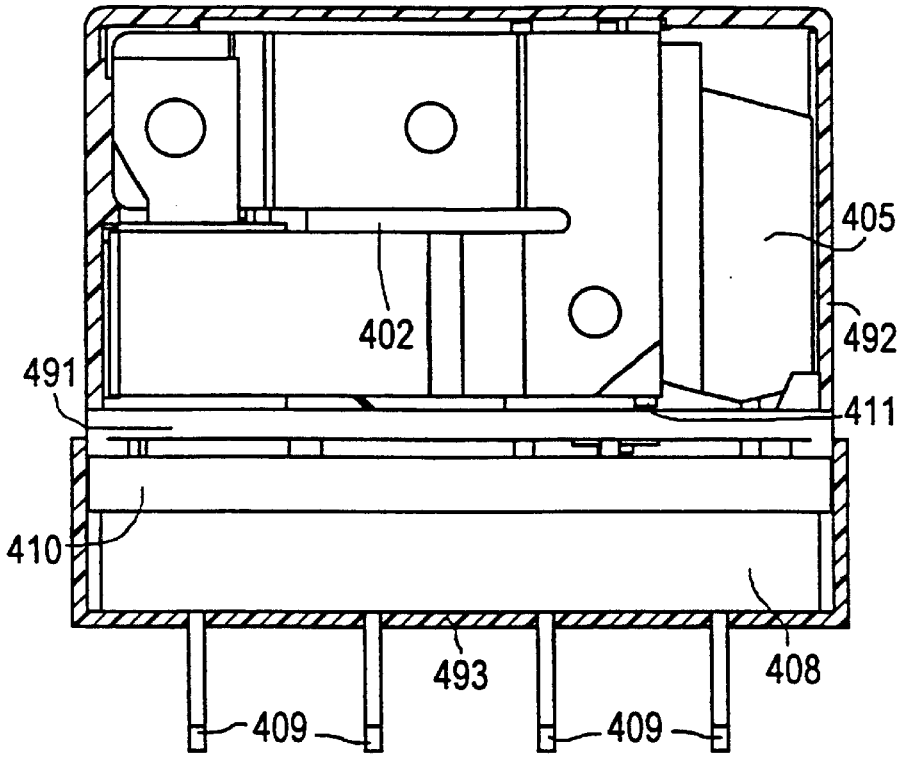
FIGS. 16 and 17 show two developments of the polarity reversal relay from FIG. 15, in combination with a printed circuit board which is fitted with the control circuit.
Figure 17:
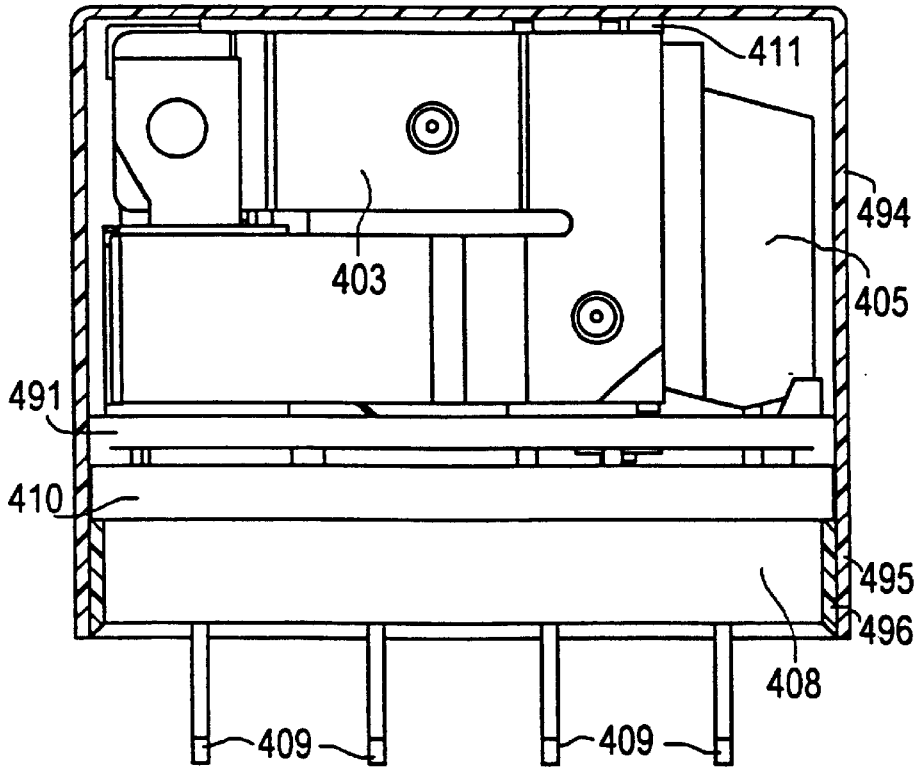

FIG. 17 also shows an embodiment of a double hybrid relay that is slightly modified from that in FIG. 16. In this case, the double relay system which has already been shown in FIGS. 14 to 16 is fitted with the power transistor 405 without a cap, and is soldered to the printed circuit board 410 fitted with the control electronics 408. A cap 494, which extends over the double relay with the transistor and the small printed circuit board 410—which is populated, for example, using SMT connection technology— is subsequently potted with a potting compound 496 as far as the cap edge 495. In this case, the relay is sealed, the SMT components are potted to provide protection, and the connecting pins 409 of the printed circuit board are potted in a stable position as far as the length that subsequently will be required.

Although the present invention has been described with reference to specific embodiments, those of skill in the art will recognize that changes may be made thereto without departing from the spirit and scope of the invention as set forth in the hereafter appended claims.

We claim as our invention:

1. A hybrid relay, comprising:

an electromagnetic relay system which includes at least one coil, a core yoke passing through the coil, at least one armature, and at least one contact pair switched by the armature; and a power semiconductor in thermal contact with the core yoke, the power semiconductor having both a switching path and a switching time wherein the switching path, together with the at least one contact pair, switches a load circuit of the relay, and wherein the switching time can be controlled to be offset in time with respect to that of the electromagnetic relay system such that the contact pair is switched on no-load.

2. A hybrid relay as claimed in claim 1, further comprising:

a control circuit; and a common integrated module, wherein both the power semiconductor and the control circuit are formed on the common integrated module.

3. A hybrid relay as claimed in claim 1, further comprising:

a control circuit wherein both the power semiconductor and the control circuit are arranged as standard modules on opposite sides of the core yoke.

4. A hybrid relay as claimed in claim 1, wherein the core yoke is formed from a substantially flat plate into a U-shape with two side limbs and one center web, the relay further comprising:

a coil formed in the center web; and two armatures, each armature bridging a side limb as a yoke and forming operating air gaps therebetween, the power semiconductor being arranged on one of the yokes.

5. A hybrid relay as claimed in claim 1, wherein the core yoke is formed from a substantially flat plate into an E-shape with two side limbs and one center limb and two core webs respectively formed therebetween, the relay further comprising:

two coils, each coil being formed in a core web; and two armatures, each armature bridging one of the side limbs and the center limb as a yoke and forming operating air gaps therebetween, the power semiconductor being arranged on the center limb.

6. A hybrid relay as claimed in claim 4, wherein each armature and the core yoke are insulated from one another and are provided with load connections, and wherein pole surfaces which form the operating air gaps on the respective armature and the core yoke are simultaneously used as contact sections.

7. A hybrid relay as claimed in claim 5, wherein each armature and the core yoke are insulated from one another and are provided with load connections, and wherein pole surfaces which form the operating air gaps on the respective armature and the core yoke are simultaneously used as contact sections.

8. A hybrid relay as claimed in claim 6, further comprising:

a break contact plate parallel to the core yoke and positioned on a side of the respective armature opposite the core yoke.

9. A hybrid relay as claimed in claim 7, further comprising:

a break contact plate parallel to the core yoke and positioned on a side of the respective armature opposite the core yoke.

10. A hybrid relay as claimed in claim 6, further comprising:

a coating of noble metal on contact sections of the armatures and the core yoke.

11. A hybrid relay as claimed in claim 7, further comprising:

a coating of noble metal on contact sections of the armatures and the core yoke.

12. A hybrid relay as claimed in claim 8, further comprising:

a coating of noble metal on contact sections of the armatures, the core yoke and the break contact plate.

13. A hybrid relay as claimed in claim 9, further comprising:

a coating of noble metal on contact sections of the armatures, the core yoke and the break contact plate.

14. A hybrid relay as claimed in claim 6, further comprising:

two embossed studs on at least one of the contact sections to form a double contact.

15. A hybrid relay as claimed in claim 7, further comprising:

two embossed studs on at least one of the contact sections to form a double contact.

16. A hybrid relay as claimed in claim 1, further comprising:

an insulating coil former which partially sheaths the core yoke to form a collar thereon, the collar further having a trough section for enclosing the power semiconductor.

17. A hybrid relay as claimed in claim 16, wherein the power semiconductor is mounted on the core yoke without any casing and is potted in the trough sections.

18. A hybrid relay as claimed in claim 16, further comprising:

additional conductor tracks in the form a stamped grid embedded in the coil former.

19. A hybrid relay as claimed in claim 1, further comprising:

an integrated control circuit for the power semiconductor positioned adjacent to the power semiconductor on the core yoke.

20. A hybrid relay as claimed in claim 1, further comprising:

at least one connecting element passed through a cut-out in the yoke section which includes the power semiconductor, the connecting element forming a contact-making surface in a region of the connecting elements of the power semiconductor.

21. A hybrid relay as claimed in claim 19, further comprising:

a contact-making tab stamped from the core yoke in a region of a contact-making plane of both the power semiconductor and the control circuit.

22. A hybrid relay as claimed in claim 20, further comprising:

a contact-making tab stamped from the core yoke in a region of a contact-making plane of both the power semiconductor and the control circuit.

23. A hybrid relay as claimed in claim 1, further comprising:

at least one angled yoke on the electromagnetic relay system, wherein the angled yoke includes a yoke limb extending alongside a coil winding and on whose outside surface the power semiconductor is mounted in a thermally conductive manner.

24. A hybrid relay as claimed in claim 23, further comprising:

a control circuit; and a printed circuit board, wherein the electromagnetic relay system is positioned on the printed circuit board, and the circuit board includes a control circuit as well as connections between the relay contacts and the switching path of the power semiconductor.

25. A hybrid relay as claimed in claim 24, further comprising:

a common cap, wherein the electromagnetic relay system, the printed circuit board and the control circuit are accommodated within the common cap, and the common cap is tightly sealed.

* * * * *